United States Patent [19]

Bergman

[11] 4,124,260

[45] Nov. 7, 1978

[54] CORRUGATED FIBERBOARD AND FOAMCORE CABINET

[75] Inventor: Walter G. Bergman, Norwich, Conn.

[73] Assignee: Scotty Fabricators Inc., Boston, Mass.

[21] Appl. No.: 842,690

[22] Filed: Oct. 17, 1977

[51] Int. Cl.[2] ..... A47B 43/02; A47B 87/00

[52] U.S. Cl. ..... 312/107; 211/194; 229/23 R; 312/259

[58] Field of Search ..... 312/259, 261, 258, 114, 312/260, 107; 229/23 R; 217/13, 45; 211/194; 206/44 R

[56] References Cited

U.S. PATENT DOCUMENTS

| | | | |
|---|---|---|---|
| 633,318 | 9/1899 | Morle | 312/261 |
| 2,021,234 | 11/1935 | Gomes | 229/23 R |
| 2,588,232 | 3/1952 | Grant | 229/23 R |
| 2,665,048 | 1/1954 | Belsinger | 229/23 R |
| 2,676,086 | 4/1954 | Stedman | 312/261 |
| 2,887,264 | 5/1959 | Fallert | 229/23 R |
| 3,375,935 | 4/1968 | Whyte | 312/259 |
| 4,011,943 | 3/1977 | Galli et al. | 206/44 R |
| 4,057,309 | 11/1977 | Fragale | 312/259 |

*Primary Examiner*—Mervin Stein
*Assistant Examiner*—A. Grosz

[57] ABSTRACT

A corrugated fiberboard or foamcore utility cabinet that includes a tubular element forming an outer housing and having one or more caged-type modules disposed within the housing to provide at least one cubicle compartment and to provide structural integrity for the cabinet.

21 Claims, 14 Drawing Figures

FIG. 10
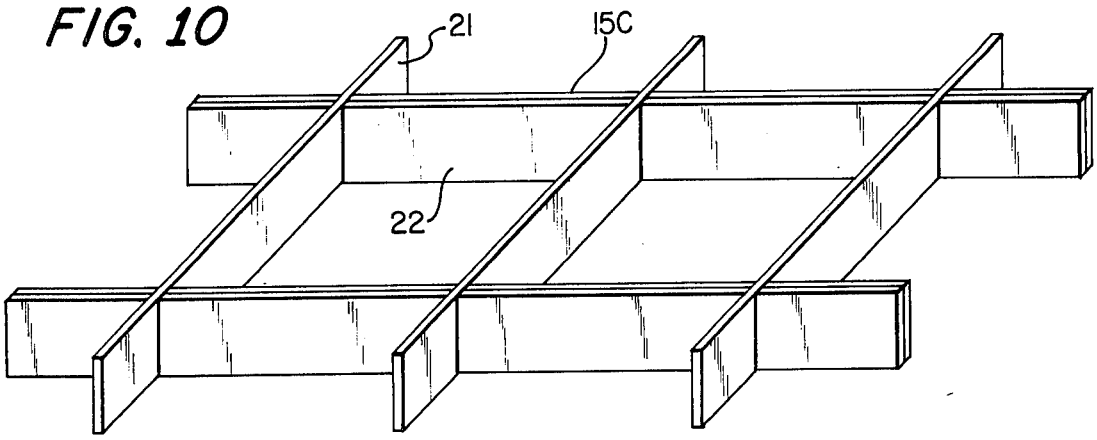
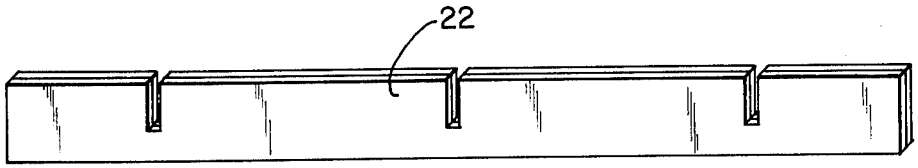
FIG. 11
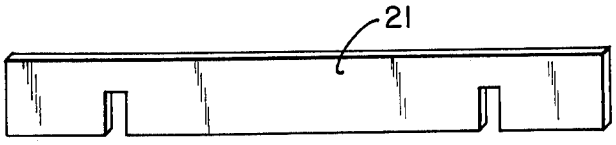
FIG. 12
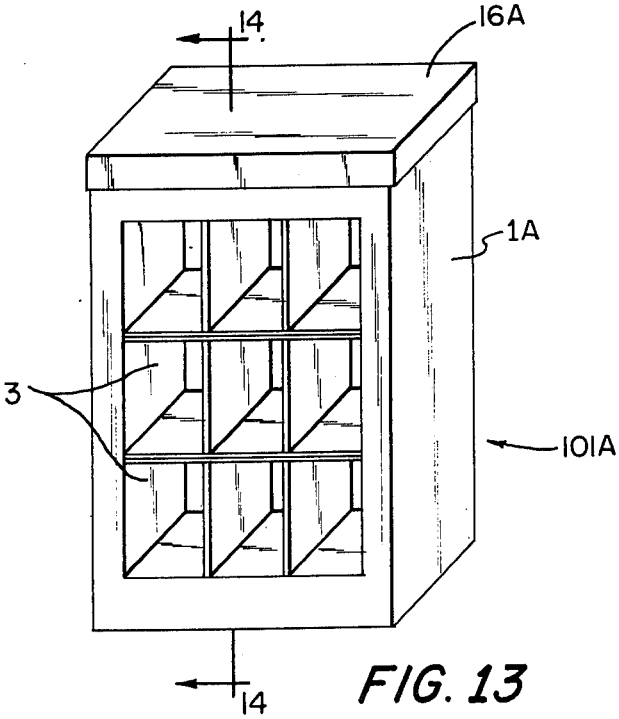
FIG. 13
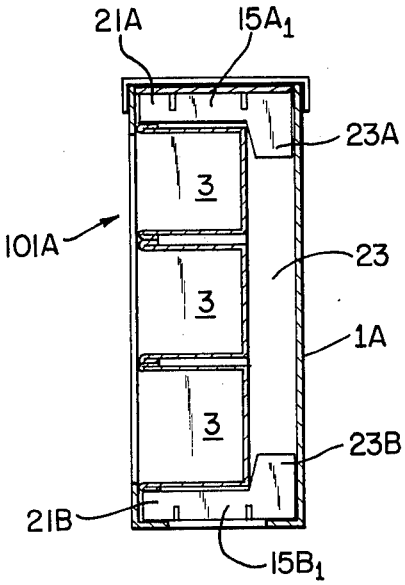
FIG. 14

CORRUGATED FIBERBOARD AND FOAMCORE CABINET

The present invention relates to utility-type cabinets composed of paper-corrugated fiberboard, foamcore, or the like.

Attention is called to U.S. Pat. No. 3,860,305 of the present inventor.

The invention herein addresses a large and increasing need for cabinets that include integrated shelves and compartments to store and/or display a wide variety of things such as high fidelity equipment and accessories, records, eight-track tapes, cassettes, books, periodicals and so forth. Such cabinets are typically open-front without doors. While the present cabinets may be used in homes, they have particular value for student dormitories, hospitals, summer cottages and the like. They are intended to replace the more conventional and expensive wood or metal cabinets now in general use, and they are intended for marketing in kit form to be assembled without use of any special tools (only an adhesive is needed) to form an integrated structure which, though formed of fiberboard or the like, is, nevertheless, a substantially sound, functional and practical structural unit. Of particular interest is the possibility of applying to the outside of the cabinets wallpaper or other decorative coating to conform to and enhance the decor of a room, allowing the expresion of a person's taste. This latter possibility is not practically possible on most wooden and metal cabinets.

Accordingly, it is a principal object of the present invention to provide a cabinet which, though fabricated of corrugated fiberboard or foamcore, or the like, nevertheless is structurally adequate and sturdy enough to replace wooden or metal cabinets in many applications.

Another object is to provide an open front, utility cabinet which can be marketed in kit form but can also be sold in factory assembled form.

Still another object is to provide a unique construction to provide O.E.M. manufacturers (e.g., encyclopedia publishers and Hi-fi manufacturers) with a relatively inexpensive cabinet for displaying their products.

These and still further objects are addressed hereinafter.

The foregoing objects are achieved in a cabinet having, in combination, a tubular element forming an outer housing, said tubular element being constructed of a paper-faced, multilayered medium, and at least one caged-type module constructed of a paper-faced, multilayered medium disposed within the housing to provide at least one cubicle compartment and to contribute to the structural integrity of the cabinet. The cabinet is designed to be marketed in either kit form, or completely assembled.

The invention is hereinafter described with reference to the accompanying drawing in which:

FIG. 10 is an isometric view of a grid that may be used at the top and bottom of the cabinet of FIG. 1 and comprising two longitudinal members and two transverse members;

FIG. 11 is an isometric view of one of the longitudinal members of the grid of FIG. 10;

FIG. 12 is an isometric view of one of the transverse members of the grid of FIG. 10;

FIG. 13 shows a modification of the cabinet of FIG. 1; and

FIG. 14 is a view taken upon the line 14—14 in FIG. 13, looking in the direction of the arrows.

Figure 1:
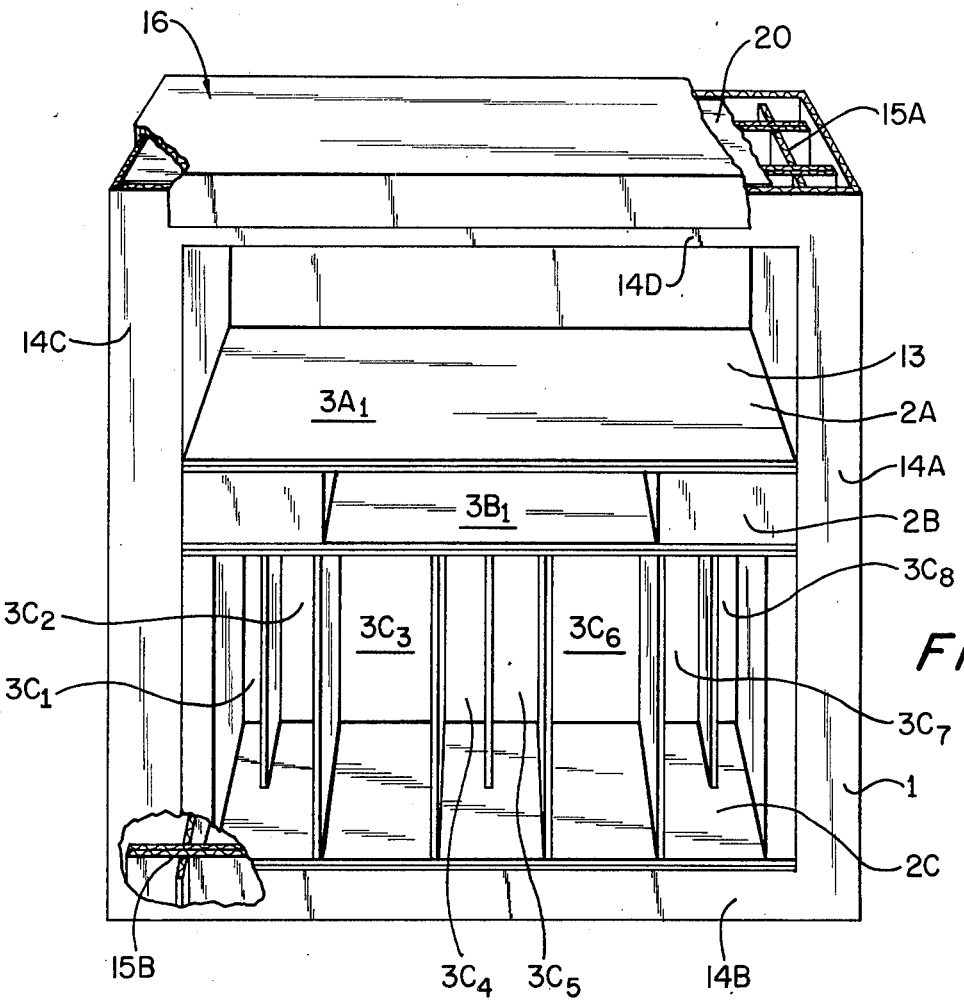
FIG. 1 is a front, isometric view, partly cutaway, showing a utility cabinet of the present invention, that includes three caged-type modules stacked, one above the other.
Figure 8:
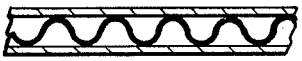
FIG. 8 is an enlarged top section view of a portion of a sheet of corrugated fiberboard.
Figure 9:
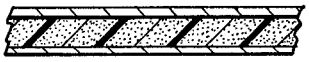
FIG. 9 is an enlarged top section view of a portion of a sheet of foamcore.

Turning now to FIG. 1, there is shown at 101 an open-front utility cabinet having a tubular element 1 forming an outer housing. The tubular element 1 is formed of a paper-lined, multilayered medium such as corrugated fiberboard (see FIG. 8) or of foamcore (see FIG. 9). A plurality of caged-type modules 2A, 2B and 2C are stacked within the housing 1 to provide cubicles $3A_1$, $3B_1$ and $3C_1$, $3C_2$ . . . and to provide structural integrity for the cabinet.

Figure 2:
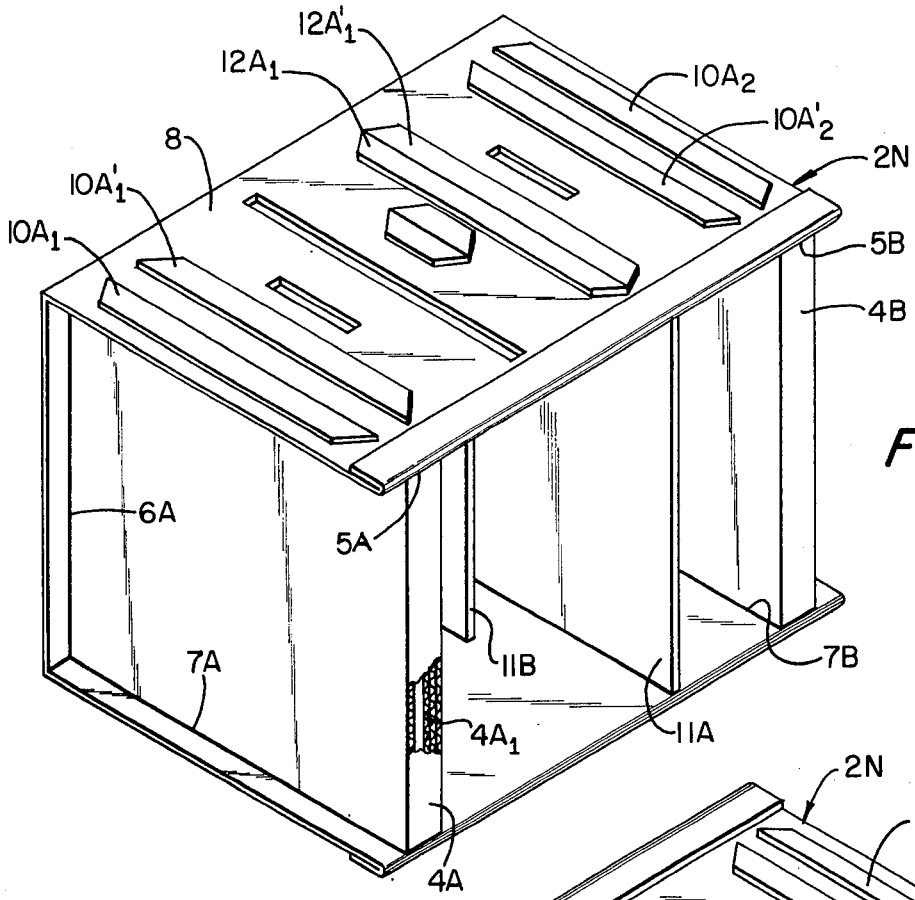
FIG. 2 is a front, isometric view, partly cutaway, of a caged-type module that can be used in a cabinet like the cabinet of FIG. 1.
Figure 3:
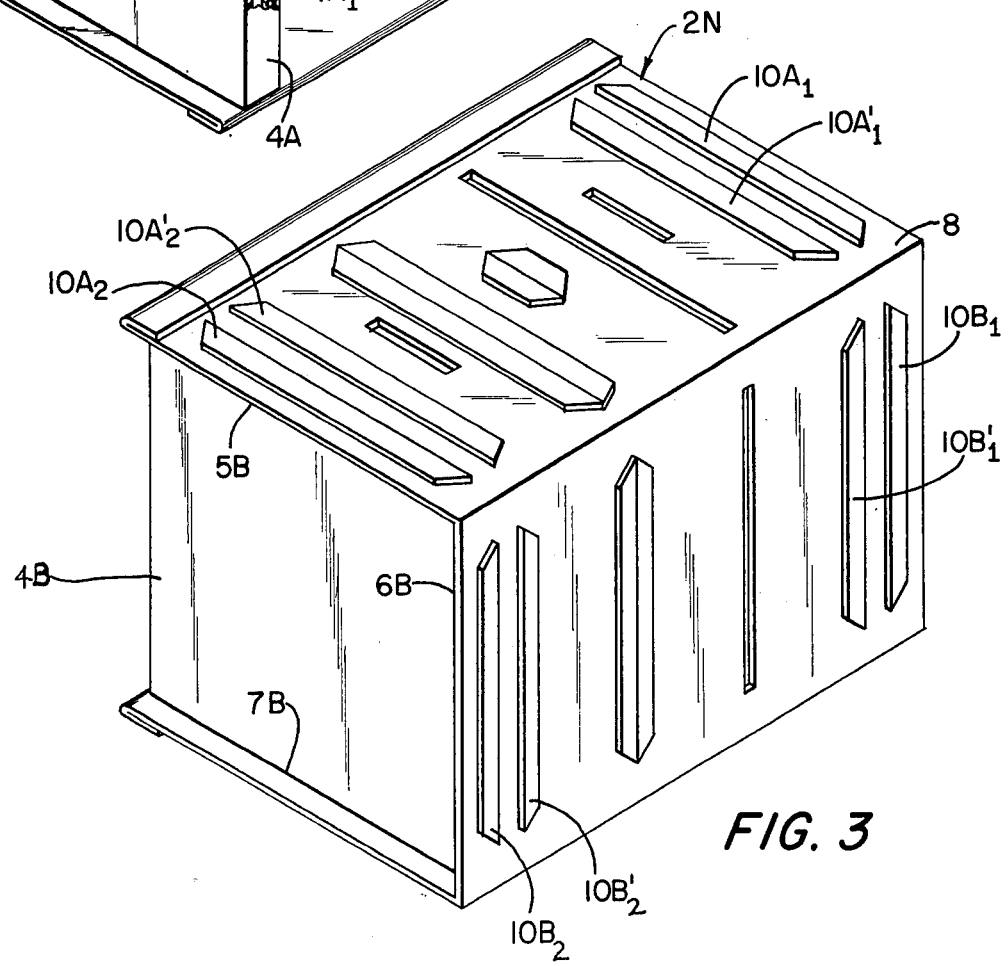
FIG. 3 is an isometric rear view of the caged-type module of FIG. 2.

One such caged-type module, labeled 2N in FIGS. 2 and 3, is now described in some detail. It should be preliminarily pointed out that the module 2N is similar in basic structure to all the modules 2A, 2B and 2C in FIG. 1, but resembles most nearly in terms of the cubicles provided, the module 2C. The caged-type module 2N comprises two vertical end members 4A and 4B surrounded respectively on the top side 5A and 5B, the back side 6A and 6B and the bottom side 7A and 7B thereof by a paper-lined, multi-layered medium wrapper 8 containing a series of attachment slots 9A, 9B . . . in FIG. 5. Each vertical end member has two attachment flaps, e.g., the flaps marked $10A_1$-$10A_1'$, $10B_1$-$10B_1'$, and $10C_1$ and $10C_1'$ of the end number 4A in FIGS. 2, 3 and 4 at each of said top side, back side and bottom side, which flaps are received by and inserted through corresponding mating slots. (The end member 4B has similar flap pairs; see the flaps labeled $10A_2$-$10A_2'$ and $10B_2$-$10B_2'$.) The flaps $10A_1$-$10A_1'$, $10A_2$-$10A_2'$, $10B_1$-$10B_1'$, $10B_2$-$10B_2'$, $10C_1$-$10C_1'$, etc., act in pairs. Thus the flap pair $10A_2$-$10A_2'$ is inserted through the slots 9A and 9B in FIG. 5 and the flap $10A_2$, as shown in FIG. 3, is folded to the left 90° while the flap $10A_2'$ is folded to the right 90°; both are then adhered to the outside surface of the wrapper 8 by an adhesive. As is discussed later, the cabinet 101 is intended to be made in kit form to be shipped to a user who assembles the same or the cabinet can be assembled at a factory and shipped in assembled form. The flaps and the receiving portion of the wrapper can have compatible mating adhesives or white poly or animal glue or hot melt can be used to adhere the flap to the wrapper to give the necessary structural rigidity required of the joint.

The caged-type module 2N further includes a plurality of vertical support and divider partitions 11A and 11B (module 2C in FIG. 1 has seven such partitions) disposed between the end members 4A and 4B, as later discussed; each has thickness greater than the thickness of the corrugated (or other) medium of which each is formed; the intermediate partitions 11A and 11B are double thicknesses of the corrugated medium, folded back on itself. Each intermediate partition has two extension flaps (e.g., the extension flaps $12A_1$ and $12A_1'$ of the partition 11A) protruding beyond the dimensional outline of the partition at each of the top side, the back side and the bottom side, and protruding through mating slots in the wrapper 8; these flaps, like the flaps of the end members 4A and 4B, are folded down at opposite 90° angles and adhered securely to the outside surface of the wrapper 8 by an adhesive medium.

Returning again briefly to FIG. 1, the tubular element 1 has a front opening 13 surrounded by four decorative flanges 14A, 14B, 14C and 14D, plus a support and spacing grid disposed at each of the top and bottom of the tubular housing 1, that is, the grids labeled 15A and 15B, respectively. The grids 15A and 15B provide support of the respective locations and act as spacing members to accommodate a variety of caged-type module sizes within one size of tubular housing. The cabinet 101 further includes a cap or cover 16 of the same material as the tubular housing fitted over and securely adhered to the top of the tubular housing and a sheet 20 of corrugated fiberboard. It should be noted at this juncture that the cabinet 101 constitutes an assembly wherein the assembled members structurally interact to provide rigidity to the cabinet as a whole.

As above indicated, the cabinet 101 is intended for marketing in kit form or completely factory assembled. The discussion that now follows relates to the kit aspects of the invention and amplifies to some extent upon the foregoing explanation.

Figure 4:
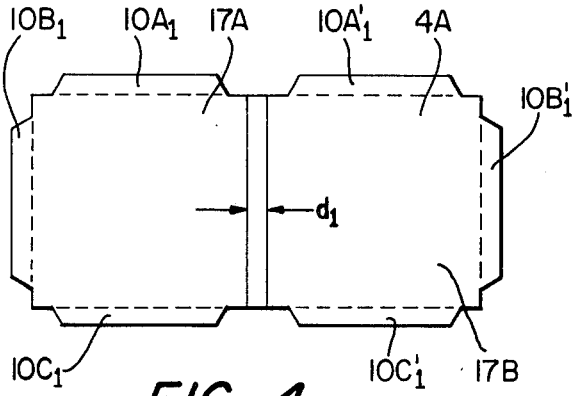
FIG. 4 is a spread-out, plan view showing a piece of shaped fiberboard that is later formed into a single end member that forms part of the caged-type module of FIG. 2.
Figure 6:
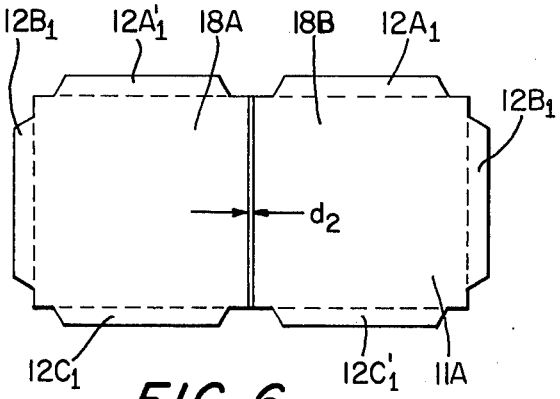
FIG. 6 is a spread-out, plan view showing a piece of shaped fiberboard that is later formed into a single internal structural member that is used as part of the caged-type module of FIG. 2.
Figure 5:
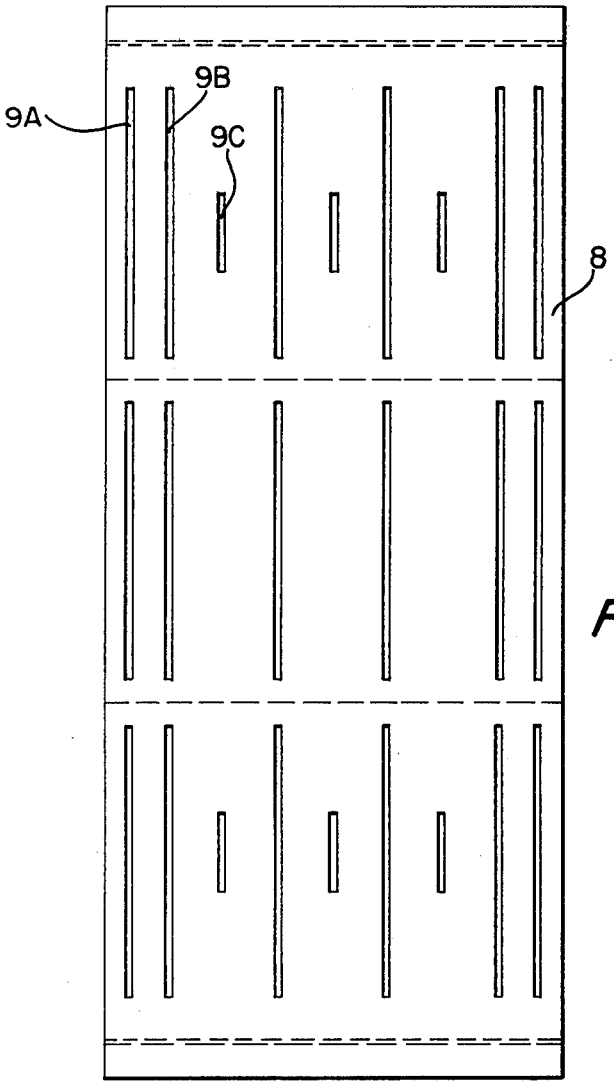
FIG. 5 is a spread-out, plan view of a piece of shaped fiberboard that is later formed into a wrapper that is used as part of the caged-type module of FIG. 2.
Figure 7:
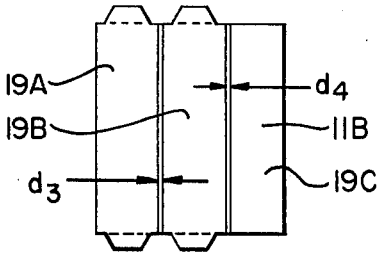
FIG. 7 is a spread-out, plan view showing a piece of shaped fiberboard that is later formed into a single internal spacer/divider structural member, like the member in FIG. 7, that is used as part of the caged-type module of FIG. 2.

Referring now to FIG. 4, there is shown an end member prior to folding and gluing; for present purposes the member is labeled 4A as in FIG. 2, but, of course, it could be labeled 4B, as well. Similarly, in FIG. 5 there is shown a wrapper, again labeled 8; in FIG. 6 there is a vertical support and divider partition, again marked 11A; and in FIG. 7 there is a further support and divider partition, again marked 11B. The members 4A, 8, 11A and 11B shown in FIGS. 4, 5, 6 and 7, respectively, are flat or planar elements, that is, they are in the form they take after being die-cut to size and shaped by use of precision die cutting equipment. Since, as above noted, the invention can be marketed in kit form, the members shown in FIGS. 4–7 are in the form they will be packaged in a kit. The members 4A, 11A and 11B in FIGS. 4, 6 and 7, respectively, have the same height dimensions, but the partition 11B is not as wide as the other two. Also, the end member 4A, when folded and glued in place, as shown in FIG. 2, is thicker than the other two, that is, the dimension labeled $d_1$ in FIG. 4 is substantially greater ($d_1$ is typically about 1 inch) than the dimension $d_2$ in FIG. 6 and $d_3$ and $d_4$ in FIG. 7. This is to provide a cosmetic effect at the left and right sides of the front opening 13 in FIG. 1. The end member 4A consists of two panels 17A and 17B, the partition 11A consists of two panels 18A and 18B and the partition 11B consists of three panels 19A, 19B and 19C. Upon assembly, the panels 17A and 17B are physically separated (a further double-thickness internal bracer $4A_1$ in FIG. 2 may be used to add strength) by about the distance $d_1$. On the other hand, the dimension $d_2$ is such that the panels 18A and 18B touch and the faces shown in FIG. 6 may, in fact, be glued together. A similar remark can be made for the panels 19A, 19B and 19C which are folded onto each other and, in the assembled partition, the panel 19C, which has glue on both sides, is sandwiched between the panels 19A and 19B and glued to each for structural strength.

The support and spacing grid shown at 15C in FIG. 10 is typical of the type grid that may be used in the cabinet 101 of FIG. 1, that is, the grids 15A and 15B are like the grid 15C. The grid 15C consists of two longitudinal members 22 and three transverse members 21. Both of the members 21 and 22 can be made of single or double thickness of single-wall A, B or C, flute corrugated fiberboard or single or double thickness of double wall corrugated, the particular material used being determined by structural requirements. Both of the members are precision die cut and have precisely dimensioned mating slots, as shown in FIGS. 11 and 12, so that the assembled grid 15C is a structurally sound unit capable of supporting substantial compressive loads; the grids 15A and 15B in FIG. 1 serve to fill the void at the top and bottom of the cabinet 101 above and below the stacked caged-modules, but, more important, they provide vertical stacking strength to the assembled unit. Also, as later discussed with reference to FIGS. 13 and 14, the upper and lower grids permit fabrication of a cabinet whose depth is greater than the depth of the caged-modules of the cabinet.

The utility shown at 101A in FIGS. 13 and 14 is used for open display of books, the particular cubicle sizes (that is, the cubicles labeled 3) shown in FIGS. 13 and 14 being useful for paperback books.

The open-front cabinet 101A consists of three stacked caged modules that together provide nine equal-sized cubicles or compartments 3, each of of which will hold 10 or 12 typical paperback books. A typical paperback has a width of about 5 inches so the cubicles 3, as shown in FIG. 14, have depths typically about 6 inches and the depth of the caged modules of the cabinet 101A are similarly about 6 inches. It has been found that the depth of a cabinet of the present type should be about 10 inches to give such cabinet stability; hence, there is a space 23 between the three tiers of caged-type modules and the tubular housing labeled 1A, as best shown in FIG. 14. To permit the tubular housing 1A to have a greater front to back dimension or depth than the caged-type modules, the grids shown at $15A_1$ and $15B_1$ have transverse members 21A and 21B, respectively, with wedge-shaped tabs 23A and 23B, respectively, that project into the void 23 and wedge the caged-type modules between the front and back of the tubular housing 1A. The cabinet 101A has a cap 16A.

It will be appreciated on the basis of the foregoing explanation that the grids used in any particular cabinet can be, for example, one grid like the grid 15C and another like the grids $15A_1$ and $15B_1$ or that other configuations can be employed within the scope of the present teaching.

Further modifications of the invention herein disclosed will occur to persons skilled in the art and all such modifications are deemed to be within the scope of the invention as defined by the appended claims.

What is claimed is:

1. An open-front utility cabinet comprising, in combination: a tubular element forming an outer housing, said tubular element being formed of a paper-lined, multilayered medium and having a front opening, with at least one open-front caged-type module formed of a paper-lined, multilayered medium disposed within and integral with the housing to provide at least one open-front cubicle compartment, the assembled outer housing and the caged-type module structurally interacting as a unitary structure to provide structural integrity for said open-front utility cabinet, said caged-type module comprising two vertical end members surrounded on the top side, back side, and bottom side thereof by a paper-lined, multilayered medium wrapper containing attachment slots, each vertical end member having at least one attachment flap at each of said top side, back side, and bottom side, which flap is received by and inserted in a corresponding mating slot and folded and adhered securely to the outside surface of said wrapper.

2. An open-front utility cabinet as claimed in claim 1 having a plurality of said modules stacked within the tubular housing with a support grid above the stack and a support grid below the stack, each grid comprising longitudinal members and transverse members with precision die cut and precisely dimensional mating slots so that the assembled grid is a structurally sound unit capable of supporting substantial compressive loads.

3. An open-front utility cabinet as claimed in claim 1 wherein each vertical end member has two attachment flaps at each of said top side, back side, and bottom side, which flaps are received by and inserted in corresponding mating slots and are folded and secured by an adhesive to the outside surface of said wrapper.

4. A utility cabinet as claimed in claim 3 wherein said module further includes at least one vertical support and divider partition disposed between the end members and surrounded on three sides by the caged wrapper, said vertical support and divider partition being attached to said wrapper on three sides thereof.

5. A utility cabinet as claimed in claim 4 wherein said at least one vertical partition is attached to the wrapper on said three sides, that is, the top side, the bottom side and the back side, in the following manner: each said vertical partition has two extension flaps protruding beyond the dimensional outline of the partition at each of the top side, the back side and the bottom side and protruding through mating slots in said wrapper, said extension flaps being folded down at opposite 90° angles and adhered securely to the outside surface of said wrapper by an adhesive medium.

6. A utility cabinet as claimed in claim 3 wherein the tubular housing contains a front opening surrounded by four decorative flanges plus a support and spacing grid disposed at each of the top and the bottom sides of the tubular housing to provide support at the respective location and to act as a spacing member to accommodate a variety of caged-type module sizes within the tubular housing.

7. A utility cabinet as claimed in claim 6 that further includes a cap cover of the same material as the tubular housing fitted over and securely adhered to the top of the tubular housing.

8. A utility cabinet as claimed in claim 1 wherein said caged-type module comprises two vertical end members surrounded on three sides by a wrapper, the end members being separated from one another to provide a cubicle therebetween, said end members being secured to the wrapper to provide structural rigidity to the caged-type module.

9. A utility cabinet as claimed in claim 8 in which the end members and the wrapper are composed of a paper-lined, multilayered medium, said end members being composed of two thicknesses of said medium separated from one another so that each end member has a thickness or width greater than the combined two thicknesses of the medium.

10. A utility cabinet as claimed in claim 9 wherein each end member has a further internal bracer for added support.

11. A utility cabinet as claimed in claim 1 comprising a plurality of stacked caged-type modules.

12. A utility cabinet as claimed in claim 11 that further includes a support and spacing grid disposed at each of the top and bottom of the tubular element, respectively, above and below the stacked caged-type modules, to provide structural vertical support for the stacked modules.

13. A utility cabinet as claimed in claim 12 wherein the depth of the tubular element is greater than the depth of the caged-type modules and wherein the grids have tabs to secure the modules within the tubular element even though the modules do not fill the whole of the interior of said tubular element.

14. A utility cabinet as claimed in claim 12 wherein each grid comprises a plurality of longitudinal members and a plurality of transverse members, each of said members being composed of a paper-lined, multilayered medium and having open slots to receive one another to provide a grid which provides said vertical structural support, said slots being precisely dimensional so that the assembled grid is a structurally sound unit capable of supporting substantial compressive loads.

15. An open front utility cabinet comprising an open-front caged-type module constructed of a paper-lined, multilayered medium and comprising two vertical end members surrounded on the top side, bottom side and back side thereof by a paper-lined, multilayered medium wrapper containing a series of attachment slots, each vertical end member having two attachment flaps on each of said top side, bottom side and back side thereof, which flaps are received by and inserted through correspondingly mating slots in said wrapper, thereafter said flaps being folded at opposite 90° angles and adhered by an adhesive securely to the outside surface of said wrapper.

16. An open-front utility cabinet kit having component parts capable of being assembled in the field comprising the combination of a caged-type module adapted to form at least one open-front cubicle compartment and to provide structural integrity for the utility cabinet, said caged-type module being formed of a paper-faced, multilayered medium, the assembled module comprising two vertical end members surrounded on the top side, back side and bottom side thereof by a wrapper having a series of attachment slots, each vertical end member having two attachment flaps at each of said top side, back side, and bottom side, which flaps are, in the assembled module, received by and inserted into corresponding mating slots and are then folded at opposite right angles to one another and adhered by an adhesive securely to the outside surface of the wrapper to form a structurally sound module capable of supporting substantial compression loads.

17. A utility cabinet kit as claimed in claim 16 that further includes an outer housing which in the assembled cabinet is tubular, open-front and receives the caged-type module, the caged-type module and the outer housing being precisely dimensioned and formed so that the caged-type module, together with the outer housing, forms a structurally sound open-front unit, the tubular outer housing being constructed of a paper-faced, multilayered medium.

18. A utility cabinet kit as claimed in claim 17 wherein the paper-faced, multilayered medium of which both the caged-type module and the tubular outer housing are constructed is corrugated fiberboard.

19. A utility cabinet as claimed in claim 17 wherein the paper-faced, multilayered medium of which both the caged-type module and the tubuler outer housing are constructed is foamcore.

20. A utility cabinet kit as claimed in claim 17 that further includes two support and spacing grids, each grid being composed of longitudinal members and transverse members each composed of a paper-faced, multilayered medium and having open slots to receive one another, said slots being precisely dimensioned so that each grid is a structurally sound unit capable of supporting substantial compressive loads, said members, in the assembled cabinet, providing structural vertical support respectively at the top and bottom of the assembled cabinet above and below the caged-type module.

21. A utility cabinet comprising, in combination: a tubular element forming an outer housing, said tubular element being formed of a paper-lined, multilayered medium, a plurality of caged-type modules formed of a paper-lined, multilayered medium disposed within and integral with the housing to provide a plurality of cubicle compartments and to provide structural integrity for said utility cabinet, each said caged-type module comprising two vertical end members surrounded on the top side, back side, and bottom side thereof by a paper-lined, multilayered medium wrapper containing a series of attachment slots, each vertical end member having two attachment flaps at each of said top side, back side, and bottom side, which flaps are received by and inserted in corresponding mating slots and are folded and adhered securely to the outside surface of said wrapper, at least one module further including at least one vertical support and divider partition that is attached to said wrapper on three sides thereof, said at least one vertical partition being attached to the wrapper on said three sides, that is, the top side, the bottom side and the back side, in the following manner: each said vertical partition has two extension flaps protruding beyond the dimensional outline of the partition at each of the top side, the back side and the bottom side and protruding through mating slots in said wrapper, said extension flaps being folded down at opposite 90° angles and adhered securely to the outside surface of said wrapper by an adhesive medium, said cabinet further including a support and spacing grid disposed at each of the top and bottom of the tubular element, respectively, above and below the stacked caged-type modules, to provide structural vertical support for the stacked modules, the depth of the tubular element being greater than the depth of the caged-type modules and the grids having tabs to secure the modules within the tubular element even though the modules do not fill the whole of the interior of said tubular element.

* * * * *